United States Patent [19]

Wittrisch

[11] Patent Number: 4,457,370

[45] Date of Patent: Jul. 3, 1984

[54] METHOD AND DEVICE FOR EFFECTING, BY MEANS OF SPECIALIZED TOOLS, SUCH OPERATIONS AS MEASUREMENTS IN HIGHLY INCLINED TO THE VERTICAL OR HORIZONTAL WELL PORTIONS

[75] Inventor: Christian Wittrisch, Rueil Malmaison, France

[73] Assignee: Institut Francais du Petrole, Rueil-Malmaison, France

[21] Appl. No.: 357,519

[22] Filed: Mar. 12, 1982

[30] Foreign Application Priority Data

Mar. 13, 1981 [FR] France ..... 81 05271

[51] Int. Cl.[3] ..... E21B 23/08; E21B 43/112; E21B 47/00

[52] U.S. Cl. ..... 166/250; 166/378; 166/383; 166/65 R

[58] Field of Search ..... 166/378, 250, 50, 65 R, 166/66, 77, 78, 113, 233, 254, 255, 153, 155, 156, 383, 385; 175/45, 50, 61, 62, 40, 104, 317, 318

[56] References Cited

U.S. PATENT DOCUMENTS

| | | | |
|---|---|---|---|
| 2,726,848 | 12/1955 | Montgomery et al. | 175/40 |
| 3,126,838 | 11/1978 | Denison | 166/206 |
| 3,550,684 | 12/1970 | Cubberly, Jr. | 166/250 |
| 3,601,196 | 8/1971 | Childers | 166/250 |
| 3,957,119 | 5/1976 | Yonker | 166/383 |
| 3,976,347 | 8/1976 | Cooke, Sr. et al. | 166/65 R |
| 4,039,237 | 8/1977 | Cullen et al. | 339/91 R |
| 4,062,551 | 12/1977 | Base | 166/242 |
| 4,064,939 | 12/1977 | Marquis | 166/253 |
| 4,166,500 | 9/1979 | McPhee | 166/250 |
| 4,168,747 | 9/1979 | Youmans | 166/250 |
| 4,319,240 | 3/1982 | Stone et al. | 175/40 |
| 4,349,072 | 9/1982 | Escaron et al. | 166/383 |

FOREIGN PATENT DOCUMENTS 0049668 4/1982 European Pat. Off. .

*Primary Examiner*—Stephen J. Novosad
*Assistant Examiner*—William P. Neuder
*Attorney, Agent, or Firm*—Millen & White

[57] ABSTRACT

A method for effecting logging or servicing operations in a predetermined inclined or horizontal zone of a well, following an initial vertical portion thereof, comprising fastening a logging or servicing tool body at the end of a string of rods lowered into the well, said tool body being provided with an electric male connector, lowering at the end of an electric transmission cable, from the surface, a female connector adapted to fit the male connector, coupling said female and male connectors by the action of a force generated at least partly by the pressure of a fluid pumped through the string of rods, and supplying electric power, through said transmission cable and said connectors, to said logging or servicing tool for its operation in said predetermined zone.

18 Claims, 15 Drawing Figures

FIG.1
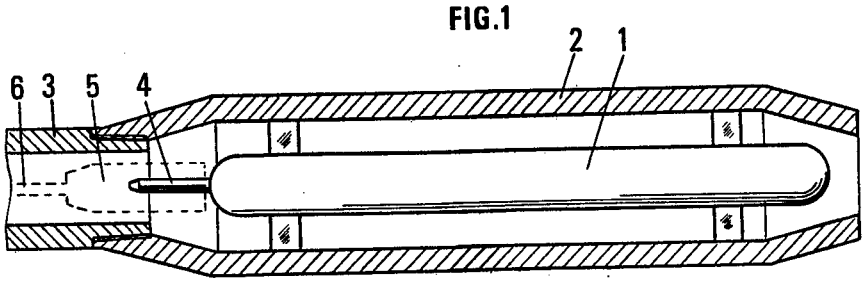
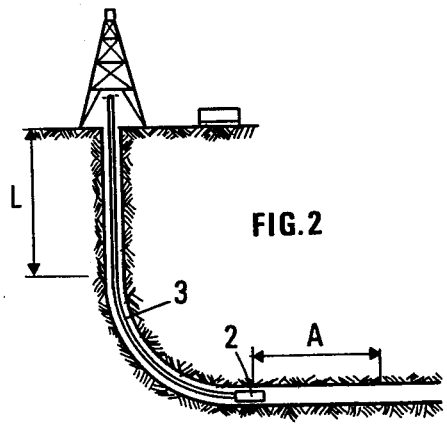
FIG.2
FIG.3
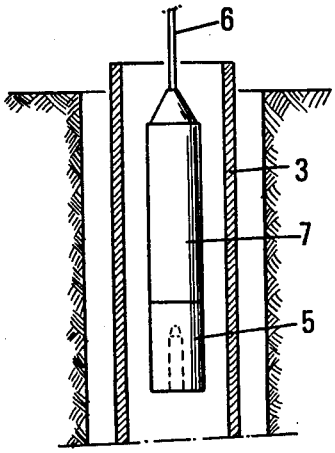
FIG.4
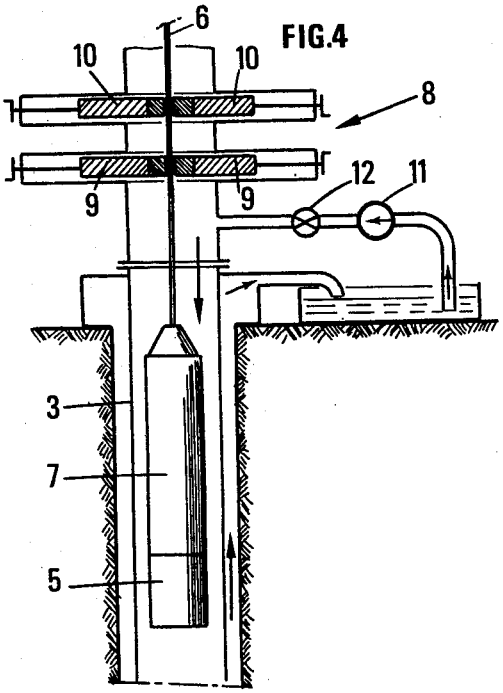
FIG.5
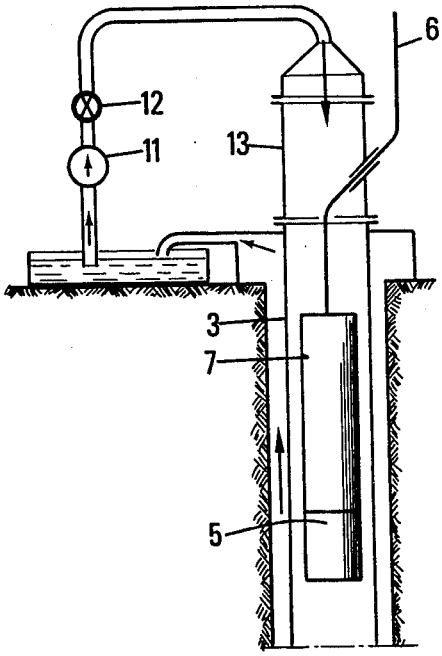

METHOD AND DEVICE FOR EFFECTING, BY MEANS OF SPECIALIZED TOOLS, SUCH OPERATIONS AS MEASUREMENTS IN HIGHLY INCLINED TO THE VERTICAL OR HORIZONTAL WELL PORTIONS

BACKGROUND OF THE INVENTION

This invention concerns a method and a device for effecting, in deviated well portions highly inclined to a vertical line or horizontal, such operations as measurements by means of specialized tools.

According to the prior art, specialized tools for effecting such operations as, for example, measurements, are secured to the end of a carrying wireline and moved into the well by the action of gravity without substantial difficulty as long as the inclination of the bore-hole with respect to a vertical line does not exceed about 45°. Beyond this limit, the displacement of the tools is only possible when the profile of the bore-hole and the diameter variations thereof are known, and by making use of tools of a small size.

For highly inclined wells, it has been proposed in U.S. Pat. No. 4,168,747 to place in the well a flexible line provided at one end thereof with a head producing fluid jets which aid the progress of the flexible line through the well. The tool is introduced into the flexible line and its displacement is obtained by pumping the fluid filling the well and the flexible line. The tool which is maintained permanently inside the flexible line is, accordingly, necessarily of a type whose operation is not disturbed by the presence of the flexible line, for example, a neutronic or $\gamma$ rays sonde for measuring the characteristics of the formations.

Such a solution suffers from a number of drawbacks. As a matter of fact, not only it is not usable with all the tools which may have to be introduced into the well, such as an electric or electromagnetic sonde, but its operation is time consuming. Moreover, the unavoidable friction of the flexible line against the wall of the well, particularly in the highly inclined portions, requires, for its progression, very powerful jets which locally damage the borehole wall. Such a device cannot therefore be used for introducing tools in highly inclined portions of great length, and in substantially horizontal well portions.

It is also known to adapt a tool such as a measuring sonde at the end of a substantially rigid hollow string so as to move it by the action of a thrust exerted on the string.

The disadvantages of this solution result from the fact that the tools placed at the end of the string rub against the wall of the well and may be damaged. On the other hand, these tools are connected to the surface through a control and measurement signals transmission cable which is housed in the bore of the hollow string, thereby making substantially more complex the assembling of the end-to-end screwed elements forming the string.

In order to reduce the latter disadvantage, there can be used a special sub generally called in the art "Side Entry Sub" and described, for example, in U.S. Pat. No. 4,062,551.

The screwing or unscrewing of the string sections above this special sub is simplified in view of the fact that above this sub, the cable is external to the hollow string. Nevertheless, the above mentioned disadvantage continues to exist for the string section between this special sub and the tool. Moreover, care must be taken to avoid blocking of the cable which, above the special sub, is located in the annular space defined between the hollow string and the wall of the well.

The location of this special sub on the hollow string is preferably selected so that, during the displacement of the string, this sub remains in the vertical section of the borehole wall.

U.S. Pat. No. 4,039,237 describes a drilling apparatus whereby a cable provided at its lower end with an electric connector which establishes the electric connection with a bottom electric motor, is lowered by gravity into the string.

It is also known from U.S. Pat. Nos. 3,976,347 and 4,126,848 to make use of electric connectors adapted to be lowered through a string of rods at the lower end of a cable for being connected to devices located at the bottom.

Such devices cannot be used to effect operations in highly deviated wells.

SUMMARY OF THE INVENTION

It is an object of the present invention to provide a method and an apparatus which do not suffer from the disadvantages of the prior art and make possible effecting operations, by means of specialized tools, in portions of wells highly inclined to a vertical line and which may be so inclined as to be horizontal.

According to the invention there is provided a method for effecting logging or servicing operations in a predetermined zone of a bored hole having, from the surface of the earth, an initial portion substantially vertical, or of slight inclination, followed by an inclined or horizontal portion, said predetermined zone being located beyond the initial portion of the well, and said method comprising the following steps of:

securing a logging or servicing tool body at the lower portion of the first rod of a string, said tool body being electrically connected to a first electric connector integral with said first rod and of easy accessibility from the upper part thereof, assembling the string by end-to-end connection of additional drill rods above said first rod, and progressively lowering into the well the assembly of the tool body and of the string of rods, as the latter is assembled, introducing into the string of rods, from the surface, a second plug-in electric connector for use in liquid medium, said second connector being mechanically secured to the lower end of an electric transmission cable and electrically connected to the surface through said cable.

The method of the invention is characterized in that said second connector, secured to the cable and weighted, is lowered into the string of rods when the tool body substantially reaches said predetermined zone of the well. This is accomplished by making the cable slide through a sealing member which is secured to the string of rods at the surface, and the second connector is moved through said inclined or horizontal portion of the string of rods by pumping of a fluid through the string of rods from the surface until said second electric connector joins said first connector. The tool body being positioned in said predetermined zone of the well, the logging or servicing operation is then effected in said zone.

According to a preferred embodiment, a pressure pulse is generated in the first rod when said second connector reaches the immediate vicinity of said first connector, so as to generate a sufficient force to urge the two connectors towards each other and join them.

The invention also provides a device for effecting logging or servicing operations by means of a specialized tool, in a predetermined zone of a bore hole. The device comprises in combination, a hollow rigid string at the end of which is secured the tool, a first electric connector connected to the tool, a string of rods connected to the upper portion of said rigid string, and an electric cable provided at its end with a second electric connector, which is complementary to the first connector. The device is characterized in that the string of rods comprises at its upper portion a sealing member wherethrough the cable may slide, and said second connector is weighted and provided with operating members for its displacement under the action of the fluid pressure inside the string of rods.

The device preferably comprises means for a relative positioning of said first and said second connectors, including the combination of a conical shoulder of the second connector, co-operating with a corresponding seat arranged in the internal wall of the rigid string, and a system for hooking the two connectors, forming a top stop member above the conical shoulder and its seat.

Preferably, said members for operating the displacement of the second connector comprise annular cups whereon acts the fluid pressure, these cups being of a diameter smaller than the internal diameter of the string of rods. In addition, an inner tubular lining, locally reducing this internal diameter so as to generate a triggering pulse, is located in the rigid string at a level slightly above that of the cups in the coupled position of the two connectors.

BRIEF DESCRIPTION OF THE DRAWINGS

The invention will be better understood and all of its advantages will be made apparent from the following description, illustrated by the accompanying drawings wherein:

FIG. 1 shows a tool secured to the end of a rigid tubular string,

FIGS. 2 through 6 illustrate the operation of the invention,

DETAILED DISCUSSION OF THE INVENTION

The tool diagrammatically shown at 1 in FIG. 1, is mechanically sheltered in a casing 2. The so-formed assembly is secured to the end of a rigid tubular string 3, made up of end-to-end screwed elements. One of the elements 4 of a tight plug-in electric connector is connected to the tool 1.

By tool it is meant here any device or operating member which is to be introduced into a bore hole to effect such operations as the determination of at least one characeristic of the formations (e.g., resistivity, acoustic impedance, measurement of the sound propagation velocity through the formations, $\gamma$ rays natural transmission, absorption rate of certain radiations, etc. . . ), operations for controlling the cementation of a tubing in the wall, location control of the joints between the elements forming the tubing, control of the exact orientation of the well, or such operations as tubing perforation, taking of solid samples of the wall of the well, collecting liquid samples into the well or dipmetering operations, this list being by no way limitative.

Of course, the shape of the casing 2 is determined by those skilled in the art in relation with the type of tool involved and may, in addition, provide for a thermal protection of the tool by circulation of a fluid such as drilling mud which usually fills the bore hole.

Figure 9:
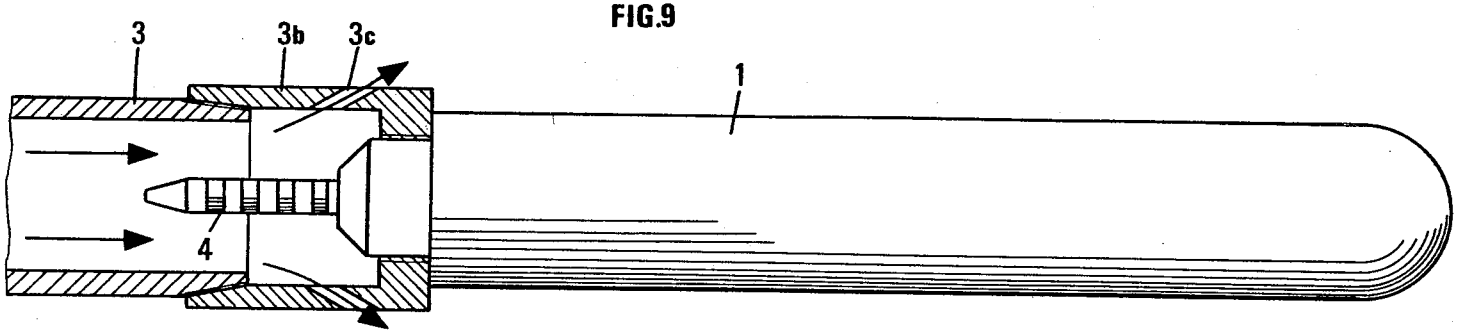
FIG. 9 illustrates the example of a tool directly secured to the end of a rigid tubular string, FIGS. 10A and 10B diagrammatically illustrate an embodiment of the invention making use of a tool which can be disengaged from its housing by remote control, FIGS. 11A and 11B respectively show the upper portion and the lower portion of the assembly formed by the weighting bar and the female electric connector, in position of connection with the male connector.
Figure 12:
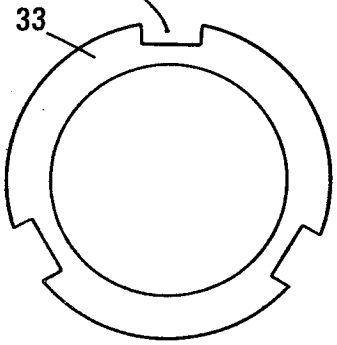
FIG. 12 shows a hooking ring after shearing thereof.

In the embodiment shown in FIG. 9, this fluid flows through openings **3*c* arranged in the connector member 3*b* surrounding the electric plug 4**.

The method according to the invention comprises the steps of fastening the assembly of the tool 1 and its sheltering casing 2 at the end of a hollow rigid string 3, without however, connecting the tool to a cable for supplying power and/or transmitting informations. Thus, the tool is in an inert state where it is not likely to be actuated inadvertently, by wrong moves or parasitic signals. This constitutes a security, in particular, for the tools comprising explosive charges which must be actuated only when the tool is at a predetermined location in the well. Moreover, it will be observed that the absence of a transmission cable makes easier the end-to-end connection of the elements forming the string 3.

Figure 6:
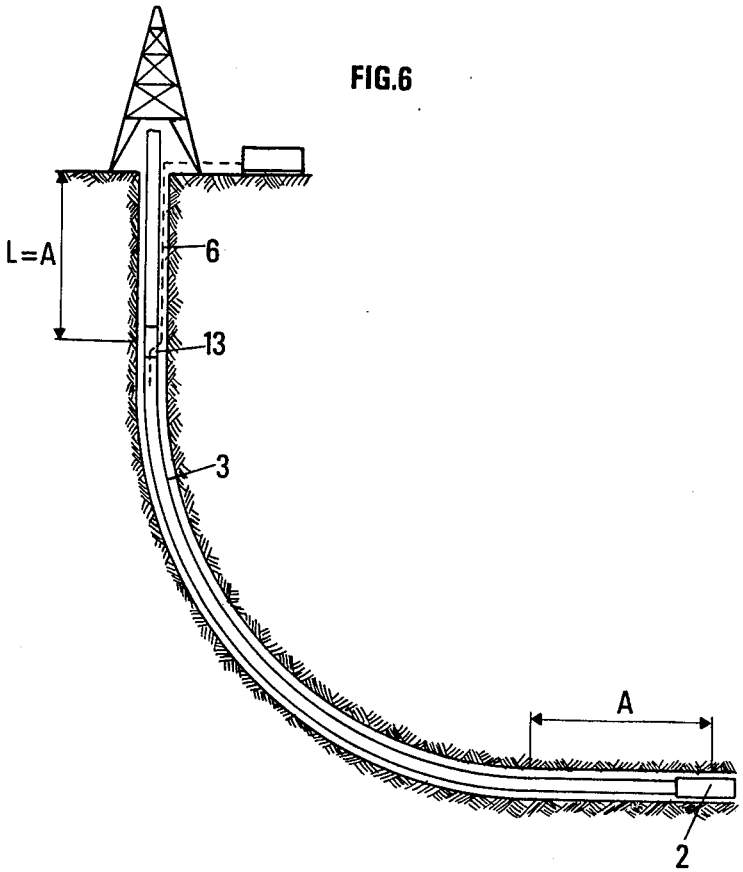

Through column 3, the tool 1, sheltered by its casing 2, is introduced and moved into the well (FIG. 2) down to the desired position, which is the exact position at which the tool must operate in the case of a tool used for only one separate operation, or which is the farthest end of the surface of a length portion A along which the tool has to operate (FIG. 6). The length of portion A is preferably at most equal to the length of the well section L which is generally vertical and extends from the surface.

For connecting the tool to a cable supplying power and/or transmitting informations, there is used a plug-in electric connector adapted to be used in fluid medium. This connector may be of any known type and for example, such as described in the U.S. Pat. No. 4,039,242.

This connector consists essentially of a socket and a plug, complementary to each other, and which fit together when brought into close relationship. One of them, for example, the plug 4 is connected to the tool. The other portion (socket 5) is secured to the end of a transmission cable 6.

When the tool has been located in the well, as above indicated, the socket 5 and cable 6 (FIG. 3) are introduced into the hollow string 3. A heavy element or weighting bar 7 overtops the socket 5 and makes easier its movement through string 3 under the action of gravity. Then, by pumping fluid through string 3, the socket 5 is displaced until its connection with plug 4 is effective. This connection may be easily controlled, for example, by means of contacts closing an electric circuit when the plug 4 is correctly engaged into socket 5. A locking device of any known type maintains the socket and the plug in their position of engagement.

In the case where the tool must only operate at a predetermined location of the well, the introduction of the socket 5 and of cable 6 into the string 3 and the pumping operation may be effected by making use of a blow out preventer (B.O.P.) well known in the field of drilling and diagrammatically shown at 8 in FIG. 4. This B.O.P. comprises jaws 9 and 10 which are radially displaceable, and which maintain the sealing about cable 6. The fluid is circulated by means of a pump 11 communicating through a valve 12 with the interior of the rigid string 3.

In the case where the tool has to operate along a portion of the well, the cable 6 is preferably introduced in the string 3 through a special sub 13 having a lateral port, generally called "side entry sub". This sub is secured to the top of string 3 as shown in FIG. 5 as soon as the sonde enters the zone to be explored (FIG. 2). It is preferably provided with means for tightening the cable in order to rigidly position the latter at the sub level after connection of plug 4 with socket 5.

Once the electric connection of the tool has been effected by the plug in connectors 4 and 5, the displacement of the tool 1 down to the end of the zone to be explored is obtained by adding rigid elements above the sub 13 (FIG. 6) over a length L equal to the length A of the zone to be explored.

Figure 5A:
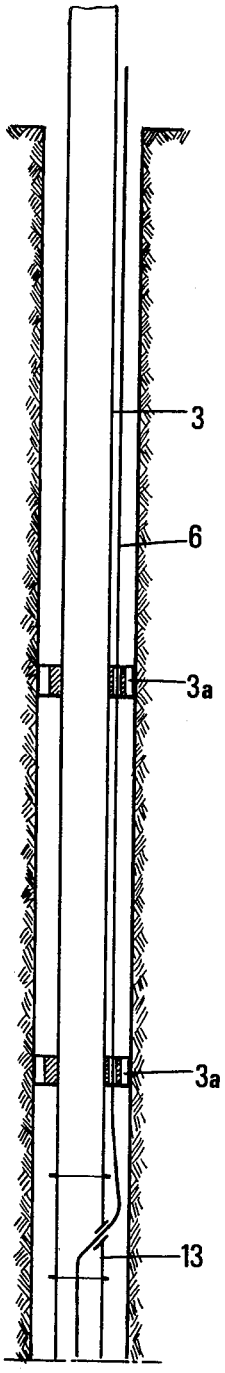

Optionally, as shown in FIG. 5A, rubber centering members 3*a*, secured to the rigid string, guide the cable 6 over a certain distance along the drill string 3 above the side entry sub 13.

These centering members may be of any known type and particularly of the type sold by the WEATHERFORD-STABILIA Company under the name "Control line".

The tool 1 is operated by remote control through the transmission cable 6, this operation being performed over the portion A of the well by progressively raising up the string 3. This raising up operation of string 3 is made easier by the fact that the cable is, at the surface, external to the string 3, which facilitates unscrewing of the tubular elements of the string.

The sub 13 may be of any known suitable type and, particularly, of the type described in U.S. Pat. No. 4,062,551.

Figure 7:
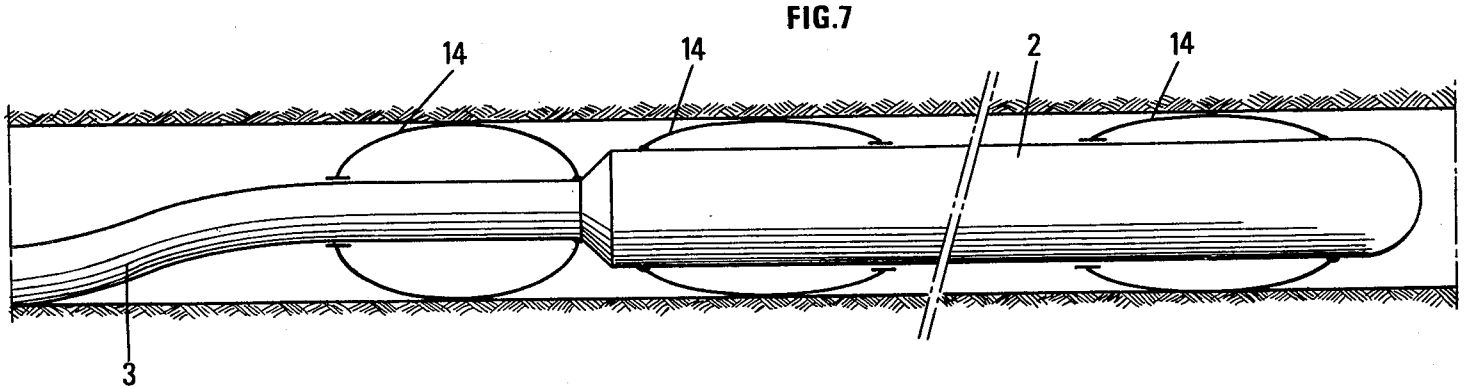
FIGS. 7 and 8 show the centering of the tool and of its casing into the bore hole.

During their operation, certain tools require to be accurately centered into the well. This may be obtained by centering members 14 secured to the casing 2 and optionally to the string 3 as diagrammatically shown in FIG. 7. These centering members are for example of the leaf type, well known in the art of earth drilling. Other types of centering members may also be used, for example centering members of rubber with mud passage.

Figure 8:
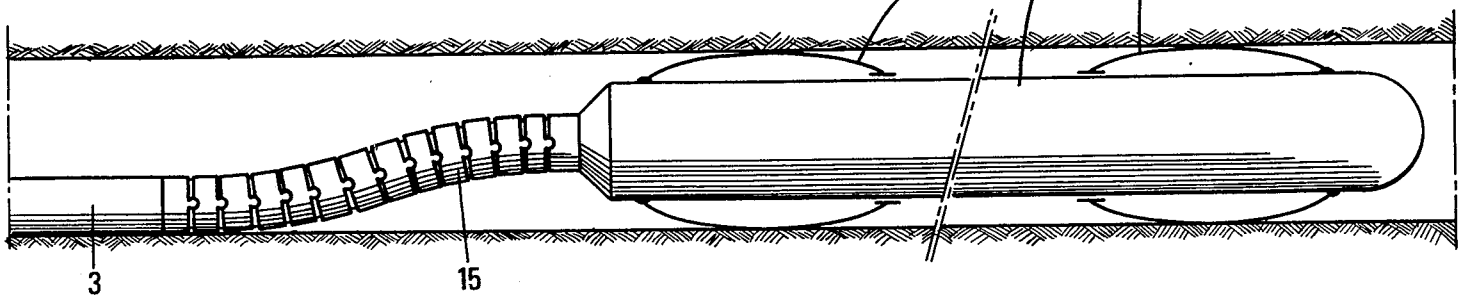

According to an embodiment illustrated in FIG. 8, the tool 1 and its casing are connected to the end of the rigid string 3 through a portion of deformable tube 15 formed for example of tubular rings or rod portions articulated with respect to each other. Such deformable rod portions are well known in the art and sold for example by ARCO DRILLING Company under the trade name "KNUCKLE JOINT".

In this case, only the casing 2 is provided with centering members 14 for maintaining the tool substantially co-axial with the well.

In order to operate under good conditions, certain tools must be disengaged from their sheltering casing 2. This is the case, for example, of electric measuring sondes known under the trade name of laterolog or "dual" laterolog, of the acoustic measuring sondes, etc. . . .

The tool may be disengaged from its casing by any known device such as, for example, a piston integral with the tool and sliding into the casing. By injection of a hydraulic fluid such as mud, the piston is displaced to disengage from the casing the active part of the tool or to retract the tool into its sheltering casing.

Figure 10A:
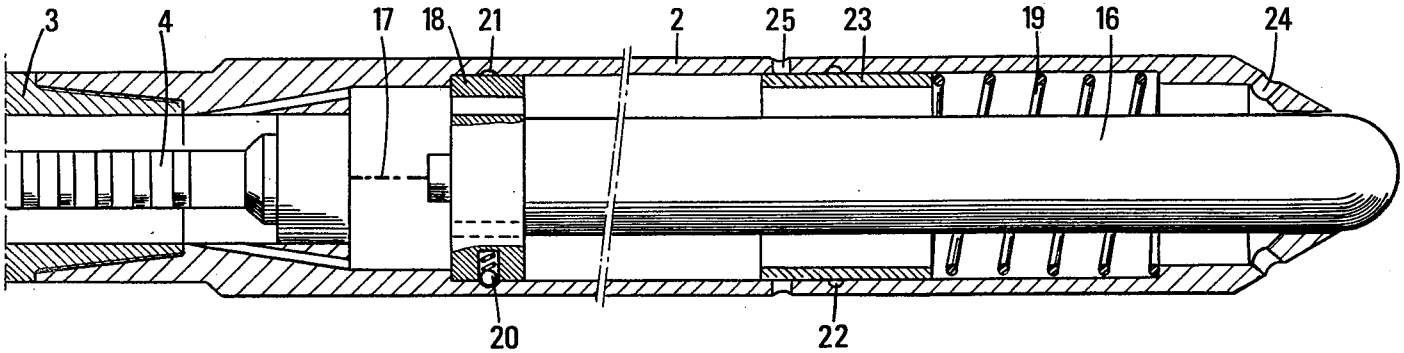
Figure 10B:
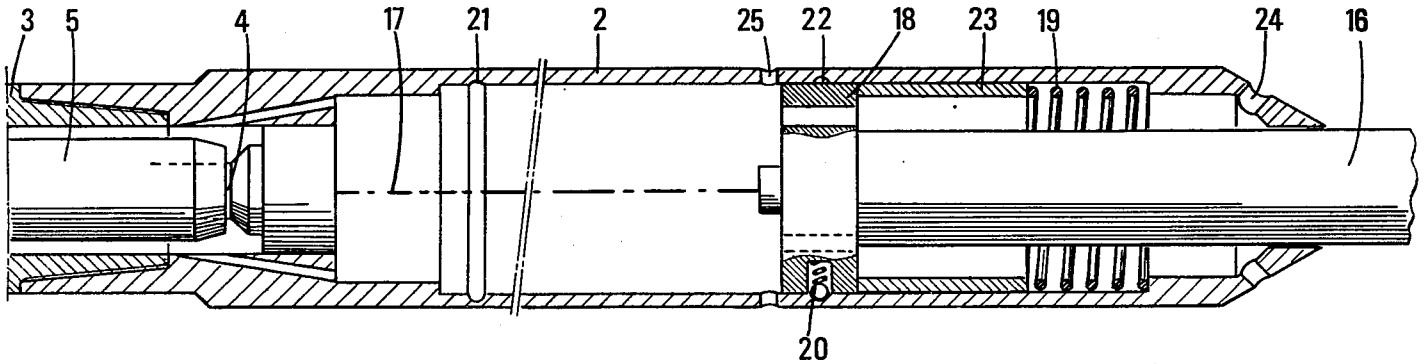

FIGS. 10A and 10B diagrammatically illustrate such an embodiment and its operation. In the example illustrated by these figures, reference 16 designates the active part of the tool electrically connected to the male connector 4 through an extending electric cable 17 and fixedly secured to a piston 18 slidably mounted inside casing 2. The assembly 16–18 may slide from a retracted position of member 16 shown in FIG. 10A to the position illustrated in FIG. 10B wherein the active part 16 of the tool projects outside the end of casing 2, as a result of an overpressure of the fluid injected into the string of rods, while compressing a return spring 19. The piston 18 is provided with a member 20 adapted to lock it in one or the other of its two limit positions by co-operation with slots 21 and 22 provided in the wall of casing 2. Through piston 18 are arranged channels allowing the flow of the drilling fluid.

In the position of FIG. 10A, this fluid escapes through ports 24 arranged at the end of casing 2, whereas lateral ports 25 are obturated by a ring 23.

When passing to the position illustrated in FIG. 10B, this ring 23 is pushed to the right by piston 18 and uncovers the ports 25 through which the fluid may also escape (as a result a pressure drop of this fluid occuring, whereby it is possible to ascertain at the surface that the active member 16 has reached its working position).

Certain tools, such as tools with pads of the density, micro-resistivity, micro-acoustic measuring type and certain perforators with explosive changes, need to be oriented in the well before their operation in order to improve their performance. Moreover, the orientation of the tool is an additional parameter to that of the measurement. The combination of these two informations in highly deviated and horizontal wells, improves the interpretation of the results. This may be the case for detecting fractures of the formation and for determination of the tubing cementation.

For this purpose, casing 2 may contain an orientation sensor such as at least one accelerometer or a gyrocompass.

For example, the use of a single accelerometer having the same axis of rotation as the tool, makes it possible to position a previously identified generatrix of the tool in a vertical plane passing through the tool axis.

The combined use of two accelerometers, whose axes of rotation are perpendicular to each other and to the tool axis, makes it possible to measure the angle formed between a vertical line and the plane containing the previously identified generatrix and the sonde axis.

Thus, the string 3 is driven in rotation from the surface in relation with the indications supplied by these sensors, so as to accurately position the tool in the well.

Modifications may be made without departing from the scope of the present invention, in particular as shown in FIG. 9.

For example, when making use of certain tools such as a tool for taking samples of liquid in the well, or a tool for perforating a tubing secured onto the wall of the well, these tools being of a type called in the art "gun" or "scallop", the casing may be integral with the tool itself or may even be omitted. In such a case, the tool 1 will be directly secured to the end of the string 3 by means of an intermediate sub 3*b* provided preferably with ports 3*c* for the fluid passage.

Figure 11A:
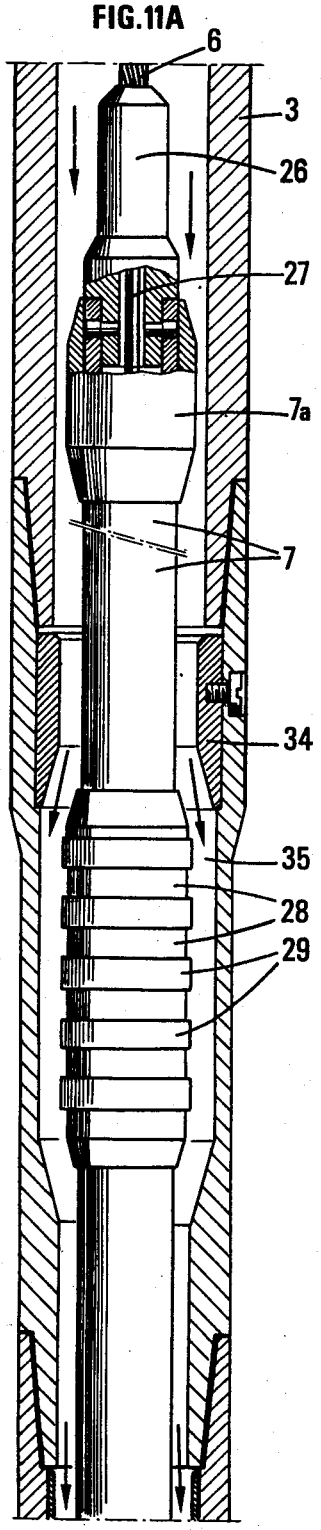
Figure 11B:
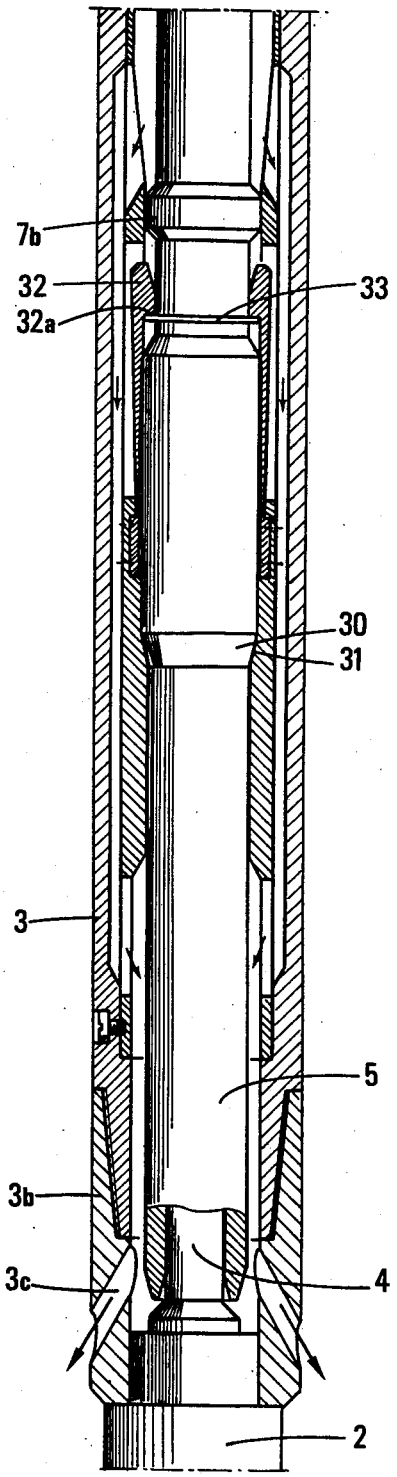

FIGS. 11A and 11B respectively show the upper portion and the lower portion of the assembly formed by the weighting part 7 and the female connector 5, in the position of connection of this assembly to the male connector 4 housed at the bottom of the string of rods 3, above the tool 1. The arrows show the flow of the fluid injected from the surface which escapes through ports 3*c* above the casing 2 (FIG 11B) or above the tool 1 (FIG. 9).

A joint 26 provides for the electric connection of conductors 27 of the cable 6 with the female connector 5.

The assembly 5–7, mechanically connected to the joint 26, comprises two centering members 7*a* and 7*b* and a sleeve 28 carrying annular cups 29 (for example of elastomer) of a diameter smaller than the internal diameter of the string of rods 3, which act as a series of pistons whereby the assembly 5–7 is moved by the fluid under pressure through the inclined portions of the well.

An accurate and reliable positioning of the female connectors with the male plug 4 is obtained by combination of:

(1) a conical shoulder 30 of the female connector co-operating with a corresponding seat 31 arranged in the internal wall of the element of the string of rods wherein the socket 5 penetrates, (2) a hooking system placed above the assembly 30–31, said system preferably comprising at least one shearable hooking ring 33 rigidly secured to the female socket 5 and a plurality of hooking and retaining elastic fingers or leaves 32, arranged inside the element of the string of rods and integral therewith (in the illustrated embodiment, three leaves are provided at an angular interval of 120°).

The hooking ring 33 being engaged under the retaining faces 32*a* of the fingers 32 by an interlocking or triggering pulse generated by the fluid pressure, (the way of producing this pulse will be indicated more precisely hereinafter), the socket 5 is then accurately positioned between a lower stop face or seat 31, (whose level corresponds to a perfect electric connection between elements 4 and 5), and the upper stop member formed by the retaining faces 32*a* of fingers 32.

By applying to cable 6 from the surface a moderate traction force (lower than that resulting in the shearing of ring 33), it can be ascertained that the hooking is effective (as a matter of fact, in such a case, the traction on the cable results in an increased tension thereof).

The socket 5 may be disconnected from the plug 4 by application of a higher traction force, resulting in the shearing of the ring 33 at the level of the leaves or blades 32. This traction force must be higher than the shearing force increased by the friction force of cable 6 all along the string of rods 3. Experiments have shown that, with such a device, it is possible to effect several successive connections and disconnections without having necessarily to raise up at each time the ring 33 to the surface for being replaced by another one, since the slots 33*a* created by the shearing during a disconnection do not register with the leaves or blades 32 at the time of a new connection.

The ring 33 may however be easily replaced at the surface after raising up the socket 5, and it would be desirable to supply or have available, sets of rings of different shearing strength to be selected in accordance with the tensile strength of cable 6.

The fluid pressure pulse producing the interlocking of ring 33 with the retaining leaves 32, and consequently, of the plug 4 with the socket 5, is obtained by placing in the string of rods, at a level slightly above that occupied by the cups 29 in position of connection of elements 4 and 5, a tubular lining 34 having a reduced inner diameter which is only slightly greater than the external diameter of the cups 29, so as to produce an abrupt increase of the downward axial thrust acting on the cups when the latter passes through the tubular lining 34, slightly before the connection.

This triggering pulse is sufficient to produce the interlocking of ring 33 with leaves 32.

At the output of the tubular lining 34, the cups 29 penetrate into a chamber of larger diameter, wherethrough the fluid can easily flow around the cups.

The respective diameters of the cups 29 and of the tubular lining 34 may be changed at will.

The above-described devices according to the invention make it possible to establish at will a continuous or periodical circulation of fluid around the tool in course of operation.

The technique of the invention is accordingly of particular interest for operating a television camera used for observing the wall of a well, for example through a viewport arranged in the wall of casing 2. As a matter of fact, in this case, it is possible to circulate, through the string of rods, limpid water which clears the field of the camera lens and ensures cooling thereof during its operation.

What is claimed is:

1. A method for effecting logging or servicing operations in a predetermined zone of a bore hole having, from the ground surface downwardly, an initial portion substantially vertical or of slight inclination, followed by an inclined or horizontal portion, with said predetermined zone being located beyond said initial portion of the well, the method comprises the steps of, (a) fixedly securing at the ground surface a logging or servicing tool body to the lower end of a first rod of a string of rods, with said tool body being electrically connected to a first electric connector rigidly secured to said first rod and accessible from the upper portion thereof, (b) assembling the string of rods, by end-to-end connection of new drill rods above the first rod, and progressively lowering the assembly of the tool body and the string of rods into the well as it is assembled, and in the absence of an external conduit extending within said bore hole from the ground surface to said predetermined measuring zone, for supporting, at its lower end, said string of rods after assembled, (c) introducing a second plug-in electric connector for use in a liquid medium, in the string of rods, from the surface, with said second connector being mechanically secured to the lower end of an electric transmission cable and electrically connected to the surface through said cable, and with said method further comprising:

(1) lowering said second connector, secured to said cable and weighted, into the string of rods when the tool body is positioned substantially at the predetermined zone of the well, by sliding the cable through a sealing member secured at the surface to the string of rods, and with said sealing member comprising a special sub with a lateral port through which the cable is passed, and which is secured to the upper end of the string of rods;

(2) displacing said second connector through the inclined or horizontal portion of the string of rods by pumping a fluid through the string of rods from the surface in a manner so as to exert a moving force on said second connector until said second connector operatively connects to said first connector;

(3) displacing the tool through the well by adding a tubular string of rod elements above the special sub to thereby position the tool body in the predetermined zone of the well; and (4) effecting the logging or servicing operation in said zone.

2. A method according to claim 1, wherein a fluid pressure pulse is generated in the lowest rod when the second connector reaches the immediate vicinity of said first connector, so as to generate a sufficient force on said second connector for bringing together and operatively connect the two connectors.

3. A method according to claim 1, wherein the cable is tightened and then fastened in position at the level of the sub after connection of the second connector with the first one.

4. A method according to claim 1, wherein the tool has an active part and is arranged in a protective casing, and the method further comprising effecting the logging operation by projecting the active part of the tool outside the casing when the tool has reached the desired position in the well.

5. A method according to claim 1, wherein the operation of the tool is triggered by raising up the string of rods, and simultaneous to said raising up operation, the method further comprising removing rods from the upper portion of the string of rods.

6. A method according to claim 1, comprising effecting said logging or servicing operations with a tool having one generatrix identified as and comprising an accelerometer having an axis of rotation the same as that of the tool, and wherein, before the operating the tool, the string of rods is rotated about its axis until a signal provided by the accelerometer indicates that the identified generatrix of the tool is in the vertical plane passing through the axis of the string of rods.

7. A method according to claim 1, comprising effecting said logging or servicing operations with a tool having one generatrix identified as and comprising two accelerometers having axes of rotation perpendicular to each other and perpendicular to the tool axis, and wherein the angle formed between the vertical plane passing through the tool axis and the plane of the tool axis and the identified generatrix is derived from the indications of the accelerometers, and further comprising rotating the string of rods about its longitudinal axis until the angle between the vertical plane passing through the tool axis and the plane of the tool axis and the identified generatrix reaches a preselected value.

8. A device for effecting logging or servicing operations with the use of a specialized tool, in a predetermined zone of a bore hole, comprising in combination a first hollow rigid rod at the end of which is fixedly secured the tool, and constructed such that no external conduit extending within the bore hole from the ground surface to said predetermined measuring zone is required for supporting, at its lower end, said string of rods when said device is in use after being assembled, a first electric connector connected to the tool, a string of rods connectable to the upper portion of said first rigid rod, and an electric cable provided at its end with a second electric connector complementary to the first connector for connection thereto, and said string of rods comprising: at its upper portion, a sealing member adapted for having the cable slide therethrough into the string of rods, and said second connector is weighted and provided with means for causing it to move downwardly through the string of rods by the effect of a fluid pressure generated inside the string of rods on the second connector, and wherein said sealing member comprises a special sub having a lateral port through which the cable can pass, with said special sub adapted for being mounted on the top of the string of rods, and for being displaced into the bore hole by a distance A through which said tool is to be moved in said predetermined zone.

9. A device according to claim 8, comprising a sub connecting the tool with the lower end of the string of rods, and having ports for the passage of a fluid.

10. A device according to claim 9, wherein said sub connecting the tool with the lower end of the string of rods comprises a mechanically sheltering hollow casing wherein the tool is housed.

11. A device according to claim 10, wherein the tool is rigidly secured to a piston displaceable into the casing between a first position where the tool is entirely protected by the casing, and a second position where at least a portion of the tool projects outside the casing.

12. A device according to claim 11, wherein the casing includes ports for the passage of a fluid.

13. A device according to claim 8, wherein the tool is secured to the lower end of a string of rods, through a flexible tubular portion, and the tool is provided with means for centering it in the well.

14. A device according to claim 8, wherein the tool and the lower end of the string of rods are provided with centering means.

15. A device according to claim 8, further comprising means for the relative positioning of said first and second connectors, said means being in combination, a conical shoulder of the second connector co-operating with a seat arranged in the internal wall of said rigid string and a system for hooking the two connectors, forming a top stop member above said conical shoulder and its seat.

16. A device according to claim 15, wherein said hooking system comprises at least one shearable ring, rigidly secured to said second connector, and a plurality of hooking and retaining elastic fingers or leaves arranged inside the internal wall of said rigid string.

17. A device according to claim 8, 9, 10, 11, 12, 13, 14, 15 or 16, wherein said means for displacing said second connector comprises annular cups on which is applied the fluid pressure, said cups having a diameter smaller than the internal diameter of the string of rods, and a tubular lining locally reducing said internal diameter for permitting generation of a triggering pulse, arranged in said rigid string at a level slightly above that of said cups in the coupling position of the two connectors.

18. A device according to claim 17, wherein said rigid string comprises, beneath said tubular lining, a chamber of larger diameter wherein are located said cups in the position of coupling of the connectors, so as to facilitate the flow of the fluid around said cups in said coupling position.

* * * * *

REEXAMINATION CERTIFICATE (620th)

United States Patent [19]

Wittrisch

[11] B1 4,457,370

[45] Certificate Issued Jan. 13, 1987

[54] METHOD AND DEVICE FOR EFFECTING, BY MEANS OF SPECIALIZED TOOLS, SUCH OPERATIONS AS MEASUREMENTS IN HIGHLY INCLINED TO THE VERTICAL OR HORIZONTAL WELL PORTIONS

[75] Inventor: Christian Wittrisch, Rueil-Malmaison, France

[73] Assignee: Institut Francais du Petrole, Rueil-Malmaison, France

Reexamination Request:
No. 90/000,995, Apr. 23, 1986

Reexamination Certificate for:

| | |
|---|---|
| Patent No.: | **4,457,370** |
| Issued: | **Jul. 3, 1984** |
| Appl. No.: | **357,519** |
| Filed: | **Mar. 12, 1982** |

[30] Foreign Application Priority Data

Mar. 13, 1981 [FR] France ..... 81 05271

[51] Int. Cl.[4] ..... E21B 23/08; E21B 43/112; E21B 47/00

[52] U.S. Cl. ..... 166/250; 166/65.1; 166/378; 166/383

[56] References Cited

U.S. PATENT DOCUMENTS

| | | |
|---|---|---|
| 2,726,848 | 12/1955 | Montgomery et al. . |
| 3,550,684 | 12/1970 | Cubberly, Jr. . |
| 3,601,196 | 8/1971 | Childers . |
| 3,957,119 | 5/1976 | Yonker . |
| 3,976,347 | 8/1976 | Cooke, Sr. et al. . |
| 4,039,237 | 8/1977 | Cullen et al. . |
| 4,062,551 | 12/1977 | Base . |
| 4,064,939 | 12/1977 | Marquis . |
| 4,126,848 | 11/1978 | Denison . |
| 4,166,500 | 9/1979 | McPhee . |
| 4,168,747 | 9/1979 | Youmans . |
| 4,194,577 | 3/1980 | Vann . |
| 4,200,297 | 4/1980 | Tricon . |
| 4,295,536 | 10/1981 | Jones, Jr. et al. . |
| 4,317,493 | 3/1982 | Thompson . |
| 4,319,240 | 3/1982 | Stone et al. . |
| 4,349,072 | 9/1982 | Escaron et al. . |

FOREIGN PATENT DOCUMENTS

| | | |
|---|---|---|
| 0049668 | 4/1982 | European Pat. Off. . |

OTHER PUBLICATIONS

Drilling Into Beds By Means Of Multiple Completion And Horizontal Wells, by A. M. Grigorian, 1969, pp. 77–83.

*Primary Examiner*—James A. Leppink

[57] ABSTRACT

A method for effecting logging or servicing operations in a predetermined inclined or horizontal zone of a well, following an initial vertical portion thereof, comprising fastening a logging or servicing tool body at the end of a string of rods lowered into the well, said tool body being provided with an electric male connector, lowering at the end of an electric transmission cable, from the surface, a female connector adapted to fit the male connector, coupling said female and male connectors by the action of a force generated at least partly by the pressure of a fluid pumped through the string of rods, and supplying electric power, through said transmission cable and said connectors, to said logging or servicing tool for its operation in said predetermined zone.

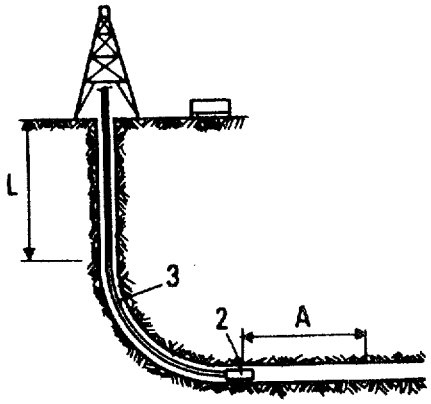

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–18 is confirmed.

* * * * *